US009380818B2

(12) United States Patent
Tippett

(10) Patent No.: US 9,380,818 B2
(45) Date of Patent: Jul. 5, 2016

(54) CONVERTIBLE TENNIS GARMENT

(71) Applicant: Sarah Scott Edwards Tippett, Raleigh, NC (US)

(72) Inventor: Sarah Scott Edwards Tippett, Raleigh, NC (US)

( * ) Notice: Subject to any disclaimer, the term of this patent is extended or adjusted under 35 U.S.C. 154(b) by 0 days.

(21) Appl. No.: 14/715,131

(22) Filed: May 18, 2015

(65) Prior Publication Data

US 2015/0327605 A1 Nov. 19, 2015

Related U.S. Application Data

(60) Provisional application No. 61/994,303, filed on May 16, 2014.

(51) Int. Cl.

| | |
|---|---|
| ***A41D 15/00*** | (2006.01) |
| ***A41D 1/14*** | (2006.01) |
| ***A41D 1/08*** | (2006.01) |
| ***A41B 9/08*** | (2006.01) |

(52) U.S. Cl.

CPC ..... *A41D 15/002* (2013.01); *A41B 9/08* (2013.01); *A41D 1/08* (2013.01); *A41D 1/14* (2013.01)

(58) Field of Classification Search

CPC ..... A41D 1/06; A41D 1/08; A41D 1/14; A41D 15/02; A41D 13/02; A41D 15/00; A41D 1/22; A41B 9/08

USPC ..... 2/227, 228, 238, 211, 212, 213, 79, 70, 2/71, 72, 105

See application file for complete search history.

(56) References Cited

U.S. PATENT DOCUMENTS

| | | | | | |
|---|---|---|---|---|---|
| 1,794,307 | A | * | 2/1931 | Lowenbaum, Jr. | A41D 1/22 2/72 |
| 1,799,336 | A | * | 4/1931 | Walser | A41D 1/22 2/71 |
| 1,889,701 | A | * | 11/1932 | Rosenberg | A41B 9/08 2/67 |
| 2,441,274 | A | * | 5/1948 | Kay | A41D 1/22 2/106 |
| 2,659,893 | A | * | 11/1953 | Hindman | A41B 9/08 2/212 |
| 2,835,897 | A | * | 5/1958 | Scruggs | A41D 13/1236 2/71 |
| 3,678,514 | A | * | 7/1972 | Safrit | A41B 9/08 2/212 |
| 3,759,510 | A | | 9/1973 | Jackson, Jr. | |
| 3,961,376 | A | | 6/1976 | Howell | |
| D247,072 | S | | 1/1978 | Morgan | |
| D249,097 | S | | 8/1978 | Rahaim | |
| D253,497 | S | | 11/1979 | Brosk | |

(Continued)

FOREIGN PATENT DOCUMENTS

| | | |
|---|---|---|
| CN | 2530477 Y | 1/2003 |
| CN | 202664277 U | 1/2013 |
| WO | WO 2013/021178 A2 | 2/2013 |

OTHER PUBLICATIONS

Freer, "It's a Skirt! It's a Pair of Leggings! It's Skeggings?," xoJane, http://www.xojane.com/clothes/skirt-meets-leggings-equals-skeggings, pp. 1-12 (Sep. 23, 2013).

(Continued)

*Primary Examiner* — Tejash Patel

(74) *Attorney, Agent, or Firm* — Jenkins, Wilson, Taylor & Hunt, P.A.

(57) ABSTRACT

The subject matter described herein includes a convertible tennis garment. The garment includes a tennis skirt. Integrated shorts are fixedly attached to and located within the tennis skirt. Leggings are removably attachable to the shorts, such that the leggings can be attached to the shorts and removed from the shorts based on environmental conditions and/or a state of warm up of the tennis player.

8 Claims, 7 Drawing Sheets

(56) References Cited

U.S. PATENT DOCUMENTS

| | | | | |
|---|---|---|---|---|
| 5,182,812 | A * | 2/1993 | Goldsby | A61H 36/00 2/227 |
| 5,539,927 | A | 7/1996 | Holubec | |
| 5,608,915 | A * | 3/1997 | Libit | A41D 1/06 2/228 |
| 5,774,892 | A | 7/1998 | Tisdale et al. | |
| 5,806,100 | A | 9/1998 | De Scandiffio | |
| 6,978,484 | B2 | 12/2005 | Donlan et al. | |
| 7,735,155 | B2 | 6/2010 | Kerkhoff | |
| 8,104,099 | B2 | 1/2012 | Olmos Plaza | |
| 8,245,322 | B1 | 8/2012 | Bouza | |
| 8,499,367 | B2 | 8/2013 | Almqvist | |
| 2008/0092273 | A1 | 4/2008 | Marshall | |
| 2009/0320175 | A1 | 12/2009 | Shih | |
| 2010/0199399 | A1 | 8/2010 | Garza | |
| 2012/0090076 | A1 | 4/2012 | Kenney et al. | |
| 2013/0125287 | A1 | 5/2013 | Boyle | |

OTHER PUBLICATIONS

REI, "Merrell Lenaia Convertible Skirt-Over-Pants—Women's," http://web.archive.org/web/20110504160549/http:/www.rei.com/product/810683/merrell-lenaia-convertible-skirt-over-pants-woman, pp. 1-2 (May 4, 2011).

* cited by examiner

CONVERTIBLE TENNIS GARMENT

PRIORITY CLAIM

This application claims the benefit of U.S. Provisional Patent Application Ser. No. 61/994,303, filed May 16, 2014; the disclosure of which is incorporated herein by reference in its entirety.

TECHNICAL FIELD

The subject matter described herein relates to a convertible tennis garment. More particularly, the subject matter described herein relates to a convertible tennis garment with integrated shorts and detachable leggings.

BACKGROUND

When playing tennis, it is desirable to have athletic wear that is both functional and aesthetically pleasing. Female tennis players typically wear a tennis skirt to achieve both of these goals. However, it may not be comfortable to wear a tennis skirt in cold weather before the tennis player has completed warm up exercises.

Alternatively, for cold weather, the tennis player may wear sweat pants when playing tennis. However, sweat pants are not aesthetically pleasing. As a result, the tennis player may wear sweat pants during warm ups and then subsequently change into a tennis skirt as the weather gets warmer and/or the player completes her warm up exercises. Requiring the change of clothing is disruptive and inconvenient for the tennis player. Accordingly, in light of these difficulties, there exists a need for an improved convertible tennis garment.

SUMMARY

The subject matter described herein includes a convertible tennis garment. The garment includes a tennis skirt. Integrated shorts are fixedly attached to and located within the tennis skirt. Leggings are removably attachable to the shorts, such that the leggings can be attached to the shorts and removed from the shorts based on environmental conditions and/or a state of warm up of the tennis player.

BRIEF DESCRIPTION OF THE DRAWINGS

The subject matter described herein will now be explained with reference to the accompanying drawing of which.

DETAILED DESCRIPTION

Figure 1:
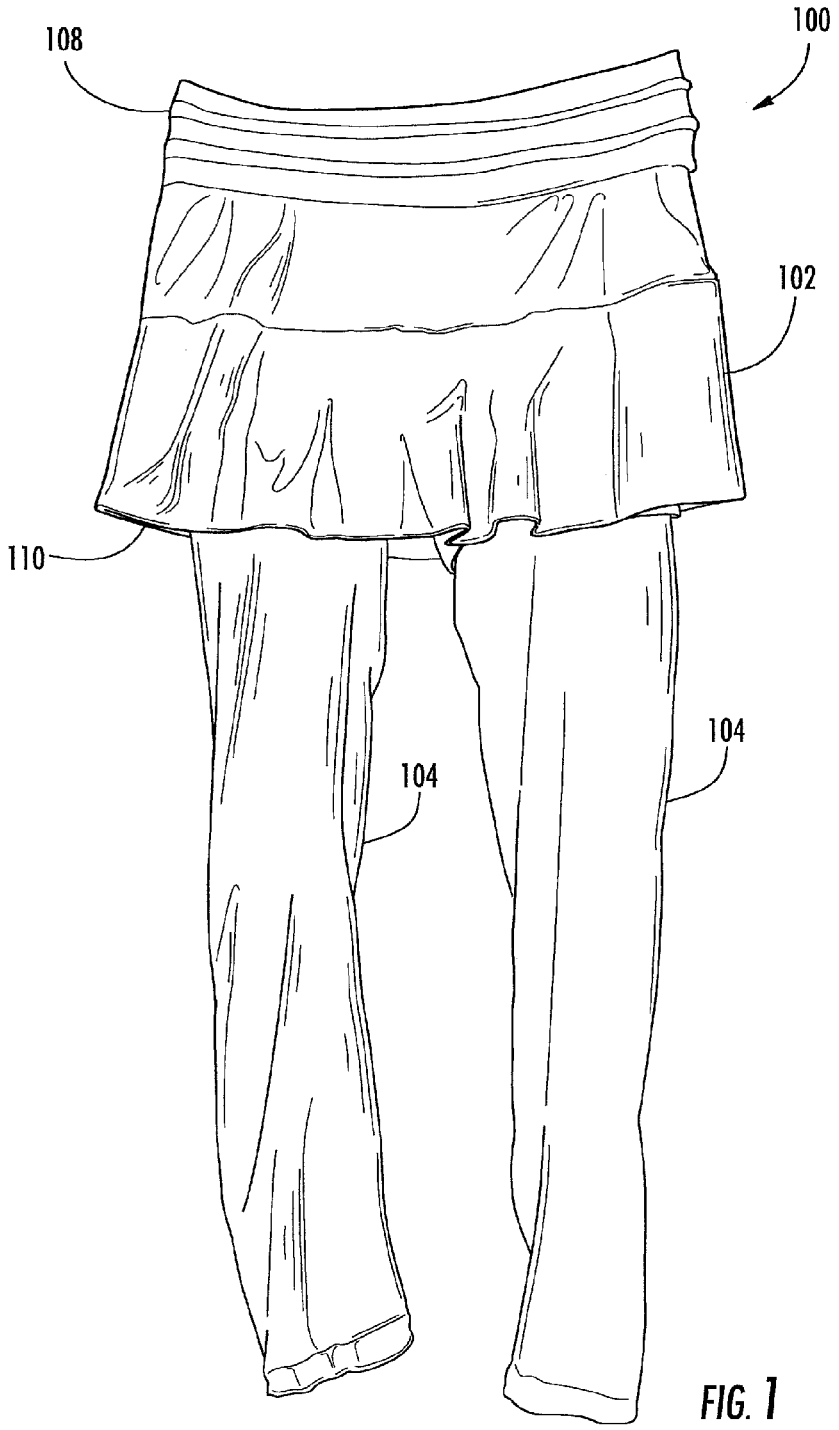
FIG. 1 is a front view of a convertible tennis garment according to an embodiment of the subject matter described herein.
Figure 2:
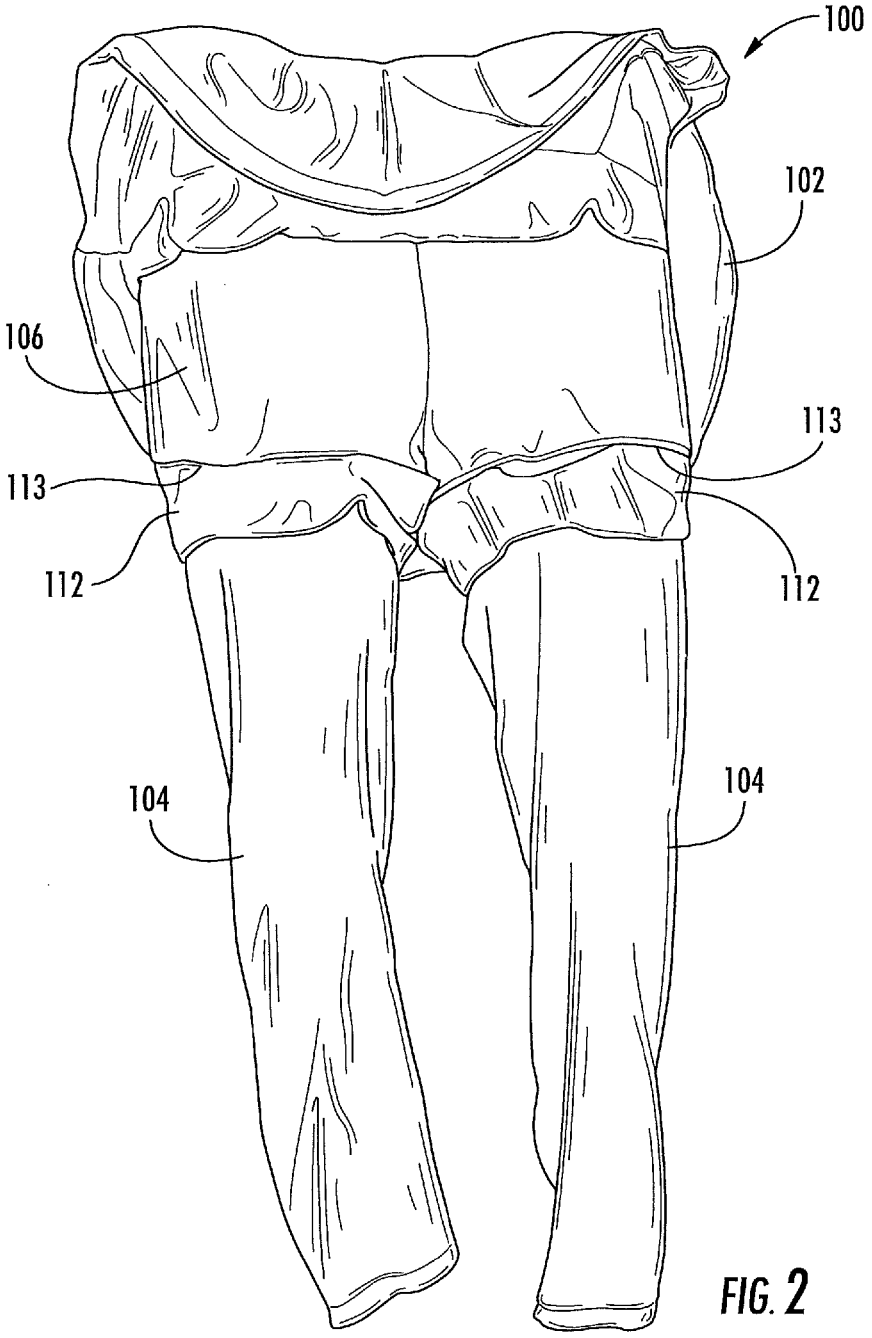
FIG. 2 is a front view of a convertible tennis garment illustrating the integrated shorts according to an embodiment of the subject matter described herein.

FIG. 1 is a front view of a convertible tennis garment according to an embodiment of the subject matter described herein. Referring to FIG. 1, convertible tennis garment 100 includes a tennis skirt 102 and leggings 104 that are removably attachable to integrated shorts 106, which are shown in FIG. 2. Tennis skirt 102 and leggings 104 may be made of a stretchable material, such as Spandex® or nylon, to make the garment comfortable and functional for tennis. In addition, tennis skirt 102 may be of a length from waist 108 to bottom 110 that is suitable for tennis. In one embodiment, the length from waist 108 to bottom 110 may be structured such that bottom 110 extends no lower than mid-thigh of the tennis player. In one example for an adult small, the length from waist 108 to bottom 110 is about 11 inches.

It can be seen from FIG. 2 that shorts 106 are fixedly attached to skirt 102. In the illustrated example, shorts 106 are sewn into skirt 102. It can also be seen from FIG. 2 that each legging 104 attaches to shorts 106 at a point that is above the bottom of shorts. In one embodiment, zippers 114 (shown in FIG. 3) attached to shorts 106 underneath the shorts so that zippers 114 will not be seen below the bottom of shorts 106. For example, as illustrated in FIG. 2, shorts 106 include portions 112 that extend below the attachment point 113 of each zipper so that zippers 114 are hidden, both when leggings 104 are attached and detached from shorts 106.

Figure 3:
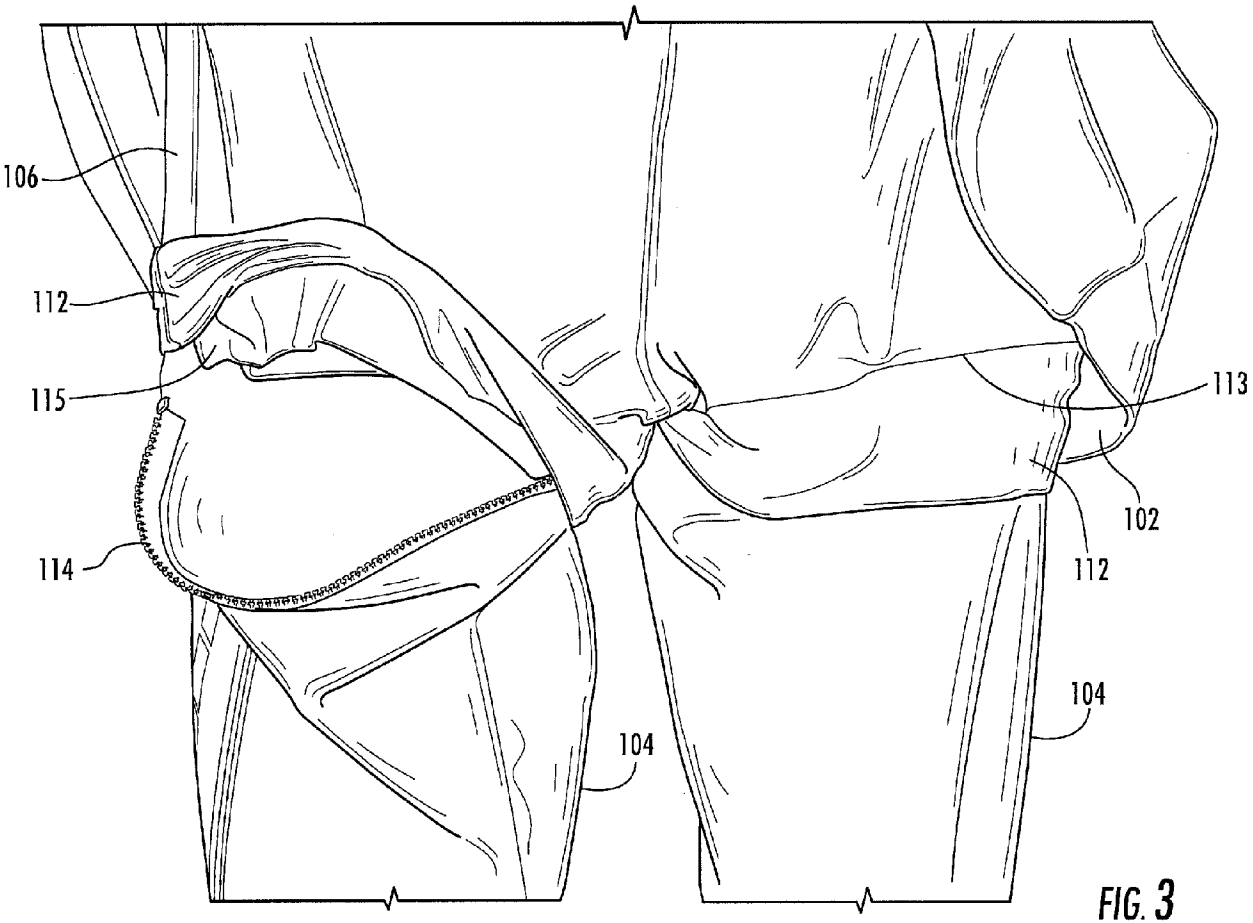
FIG. 3 is a front view of a convertible tennis skirt illustrating removable attachment of one of the leggings via a zipper according to an embodiment of the subject matter described herein.

FIG. 3 is a close up view of leggings 104, shorts 106, and one zipper 114 used to removably attach its corresponding legging 104 to shorts 106. In the illustrated example, zipper 114 for the tennis player's right legging is shown. It is understood that the left legging would include a similar zipper. Zipper 114 extends circumferentially around the diameter of each legging 104 to allow each legging 104 to be completely removed from shorts 106, for example, when the tennis player is warmed up or when environmental conditions do not require leggings. In addition, each zipper 114 includes a circumferential backing member 115 designed for positioning between each zipper 114 and the tennis player's skin to isolate each zipper 114 from the tennis player's skin and increase the comfort provided by garment 100. In one embodiment, each backing member 115 may be made of a soft, stretchable material, such as nylon or Spandex® blended with cotton.

Figure 4:
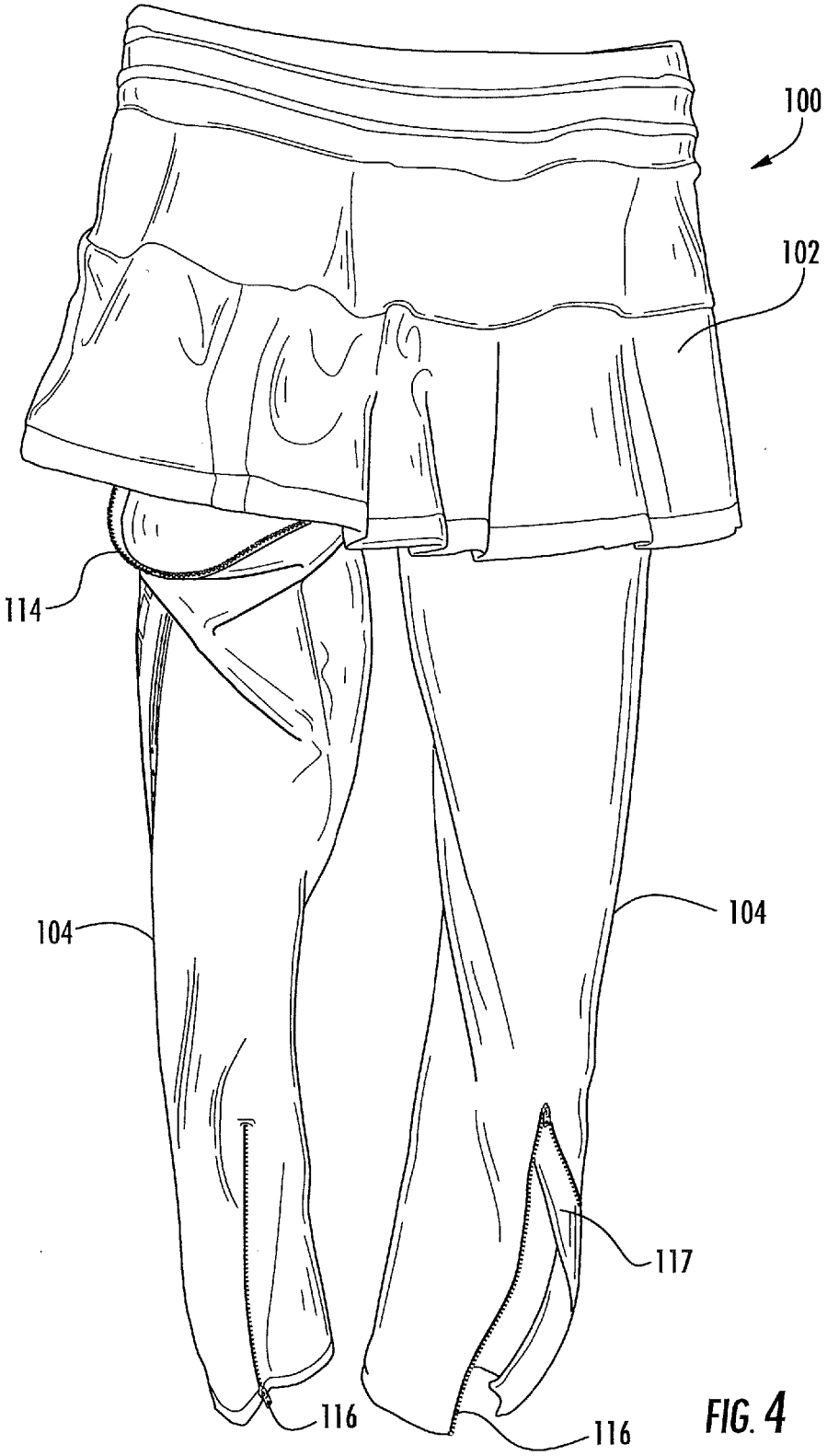
FIG. 4 is a close up view of a convertible tennis skirt illustrating removable attachment of one of the leggings to the integrated shorts according to an embodiment of the subject matter described herein.

According to another aspect of the subject matter described herein, as illustrated in FIG. 4, each legging 104 may include a longitudinal zipper 116 that begins at the bottom of each legging 104 and extends longitudinally along each legging 104 for a distance sufficient to allow the user to remove the leggings over footwear, such as a tennis shoe. In the illustrated example, the longitudinal zipper 116 on the user's left legging is unzipped and the zipper 116 on the user's right legging is zipped. A longitudinal backing member 117 may be sewn or otherwise attached to each legging 104 for positioning between each zipper 116 and the tennis player's skin. In one embodiment, each backing member 117 may be made of a soft, stretchable material, such as nylon or Spandex® blended with cotton.

Figure 5:
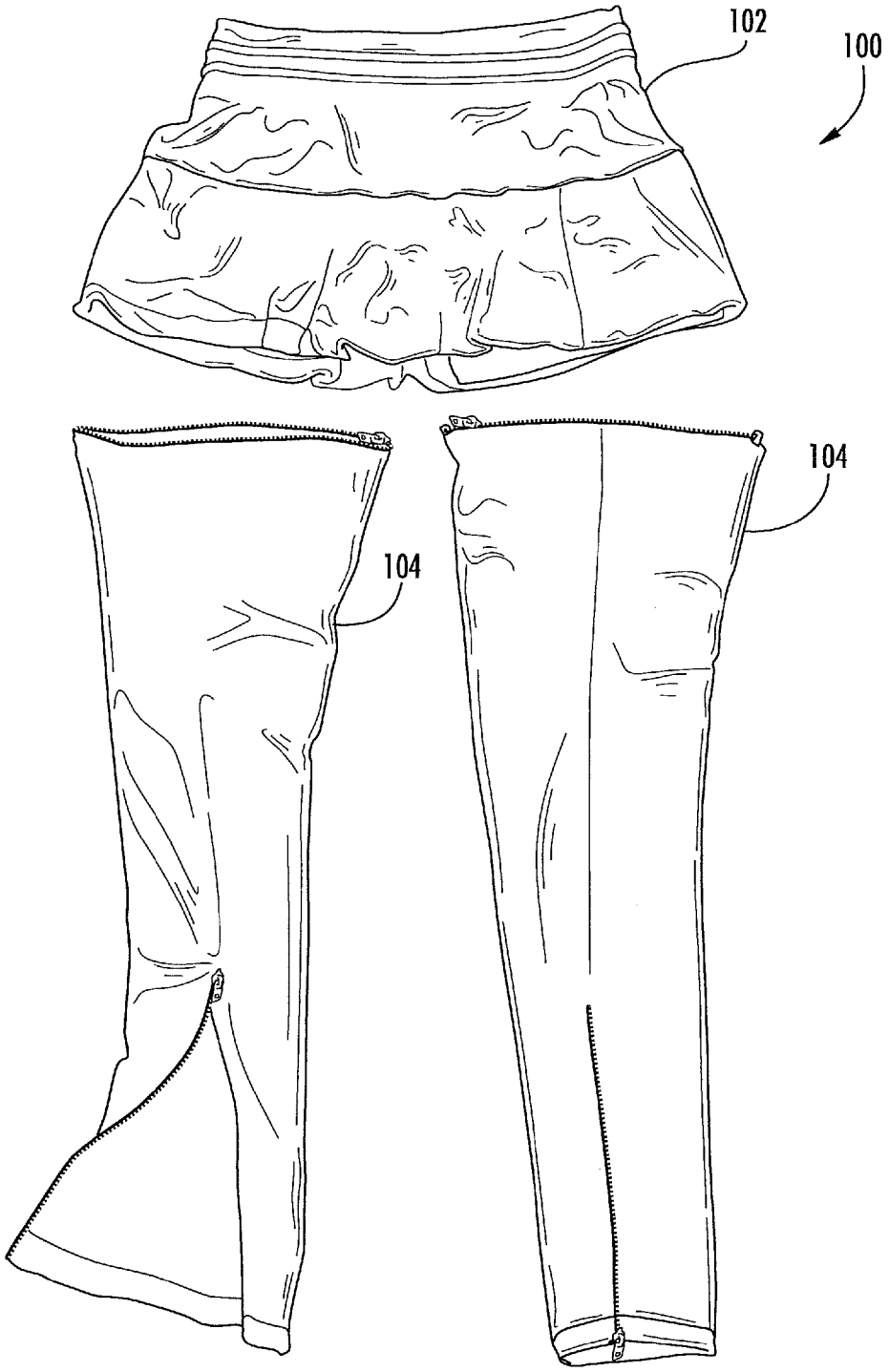
FIG. 5 is a view of a convertible tennis skirt with the leggings removed according to an embodiment of the subject matter described herein.

FIG. 5 is a diagram illustrating garment 100 with leggings 104 completely removed from skirt 102. In FIG. 5, both leggings 104 are shown in rear view so that zippers 116 are visible.

Figure 6:
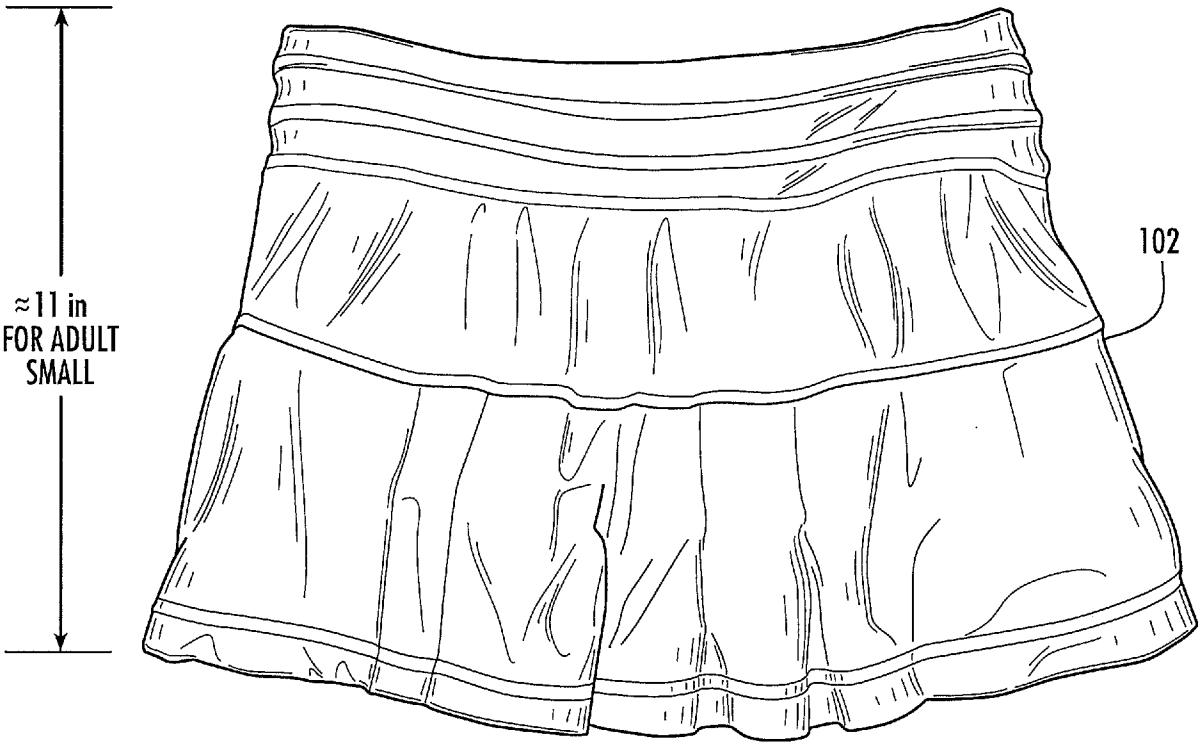
FIG. 6 is a front view of a convertible tennis skirt with the leggings removed according to an embodiment of the subject matter described herein.

FIG. 6 is a diagram of skirt 102 with leggings completely removed. In FIG. 6, skirt 102 is about 11 inches in length measured from the waist to the bottom of the skirt for an adult small. It is understood that different lengths may be appropriate for different sizes. As stated above, skirt 102 is preferably designed for tennis such that the bottom of skirt 102 rests no lower than mid-thigh on a tennis player. Thus, for an adult medium, skirt 102 may be longer than 11 inches. In addition, skirt 102 may be pleated, which further increases its utility for tennis.

Figure 7:
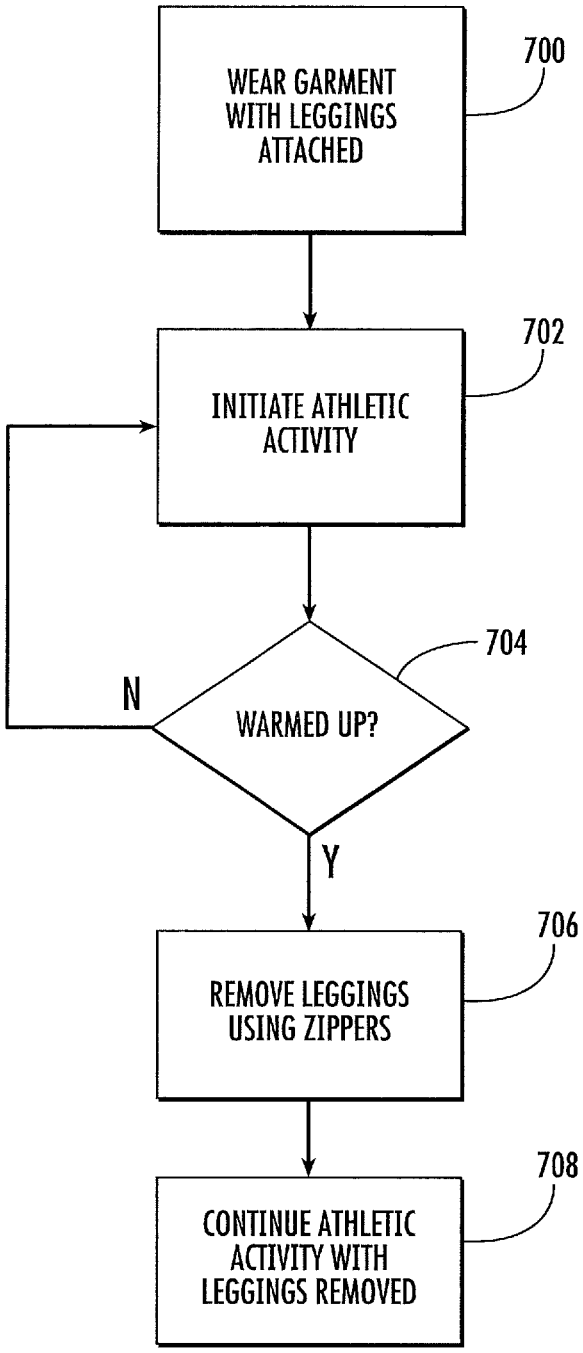
FIG. 7 is a flow chart illustrating a method for using a convertible tennis garment according to an embodiment of the subject matter described herein.

According to another aspect, the subject matter described herein includes a method for playing tennis using a convertible tennis garment. FIG. 7 is a flow chart illustrating an exemplary process for using convertible tennis garment 100 according to an embodiment of the subject matter described herein. Referring to FIG. 7, in step 700, the user wears the garment with the leggings attached. In step 702, the user initiates an athletic activity such as tennis. In step 704, it is determined whether the user and/or environmental conditions have warmed up since initiating the athletic activity. If the user and/or the environment has not warmed up, control returns to step 702 where the user continues in the athletic activity. If the user and/or the environment has warmed up, control proceeds to step 706 where the user removes the leggings using the zippers. In step 708, the user continues in the athletic activity with the leggings removed.

While the diagram illustrated in FIG. 7 illustrates the use of the garments with the leggings initially attached, in an alternate embodiment, the user may initially start with the leggings detached and if the user's and/or the environment's warm up state changes, the user may attach the leggings. For example, the user may desire to attach the leggings after completing the athletic activity and cooling off.

It will be understood that various details of the subject matter described herein may be changed without departing from the scope of the subject matter described herein. Furthermore, the foregoing description is for the purpose of illustration only, and not for the purpose of limitation.

What is claimed is:

1. A convertible tennis garment comprising:

a tennis skirt;

integrated shorts fixedly attached and at least partially located within the tennis skirt;

leggings removably attachable to the shorts, such that the leggings can be attached to the shorts and removed from the shorts depending on environmental conditions and/or a state of warm up of a tennis player; and longitudinal zippers extending from a bottom of each of the leggings for a longitudinal distance up each of the leggings sufficient to allow removal over a tennis shoe.

2. The convertible tennis garment of claim 1 wherein the tennis skirt and the leggings are made of a stretchable material.

3. The convertible tennis garment of claim 2 wherein the stretchable material comprises Spandex® or nylon.

4. The convertible tennis garment of claim 1 wherein the tennis skirt has a length such that the bottom of the skirt extends no lower than mid-thigh of a tennis player.

5. The convertible tennis garment of claim 1 comprising zippers extending circumferentially around each of the leggings to removably attach each of the leggings to the shorts.

6. The convertible tennis garment of claim 5 wherein the zippers attach to the shorts at a position above a bottom of the shorts.

7. The convertible tennis garment of claim 6 comprising circumferential backing members located behind each zipper for positioning between each zipper and a tennis player's skin in use.

8. The convertible tennis garment of claim 1 comprising longitudinal backing members located behind each longitudinal zipper for positioning between each longitudinal zipper and a tennis player's skin in use.

* * * * *